US005873301A

United States Patent [19]

Satake et al.

[11] Patent Number: 5,873,301

[45] Date of Patent: Feb. 23, 1999

[54] ROLL TYPE HUSKING APPARATUS WITH INCLINED GUIDE CHUTE

[75] Inventors: Satoru Satake, Tokyo; Kenjiro Okuno, Hiroshima-ken; Akira Fukuhara, Higashihiroshima; Seiji Yorioka, Hiroshima, all of Japan

[73] Assignee: Satake Corporation, Tokyo, Japan

[21] Appl. No.: 890,700

[22] Filed: Jul. 11, 1997

[30] Foreign Application Priority Data

Jul. 22, 1996 [JP] Japan ..... 8-209384

[51] Int. Cl.[6] ..... B02B 3/00; B02B 3/02; B02B 3/04; B02B 3/06

[52] U.S. Cl. ..... 99/488; 99/519; 99/523; 99/524; 99/609; 99/618; 99/620; 99/621

[58] Field of Search ..... 99/486, 488, 489, 99/518, 519, 523–525, 609–611, 612–615, 617–622, 623–625, 600; 241/7, 11, 14, 37, 42, 49, 74, 257.1; 426/481–483, 518

[56] References Cited

U.S. PATENT DOCUMENTS

| | | | |
|---|---|---|---|
| 3,885,464 | 5/1975 | Ceballos-Aguilera | 99/600 X |
| 3,960,068 | 6/1976 | Salete | 99/610 X |
| 3,995,542 | 12/1976 | Miecke | 99/569 |
| 4,194,445 | 3/1980 | Gemsjager | 99/523 X |
| 4,196,224 | 4/1980 | Falk | 426/483 |
| 4,292,890 | 10/1981 | Salete-Garces | 99/610 X |
| 4,693,903 | 9/1987 | Halwani | 99/518 X |
| 5,048,407 | 9/1991 | Salete-Garces | 99/519 |
| 5,050,808 | 9/1991 | Satake et al. | 241/37 |
| 5,209,158 | 5/1993 | Salete-Garces | 99/617 X |
| 5,295,629 | 3/1994 | Satake et al. | 241/74 X |
| 5,415,085 | 5/1995 | Thomson | 99/574 |
| 5,678,477 | 10/1997 | Satake et al. | 99/519 |

FOREIGN PATENT DOCUMENTS

| | | |
|---|---|---|
| 596415C | 4/1934 | Germany . |
| 439399 | 12/1935 | United Kingdom . |
| 2 054 346 | 2/1981 | United Kingdom . |

OTHER PUBLICATIONS

European Search Report for Appln. No. EP 97 11 2291, Oct. 16, 1997.

*Primary Examiner*—Timothy F. Simone
*Attorney, Agent, or Firm*—Darby & Darby

[57] ABSTRACT

A husking apparatus for cereals comprises a pair of rolls provided parallel to each other with a clearance therebetween, and an inclined guide chute situated above the rolls. The guide chute slides down cereal grains between the rolls, and the rolls rotate in opposite directions, respectively, to nip and shell the cereal grains therebetween. The guide chute and the rolls are located so that a guide surface of the guide chute is substantially perpendicular to a line connecting the centers of rotational shafts, and that an extension line from the guide surface passes within a range of ±10 mm on both sides of a middle point of the clearance between the first and second rolls. The guide surface of the guide chute has such an inclination that the cereal grains spread all over a width of the guide surface in the substantially single layer of a band-like shape and are accelerated up to a speed less than peripheral speeds of the rolls while they slide down along the guide surface. The cereal grains are thus uniformly fed between the rolls in regular postures and have less irregular reflection due to collision with the rolls, and it is possible to perform reliable husking which causes less broken grains.

16 Claims, 10 Drawing Sheets

FIG. 4
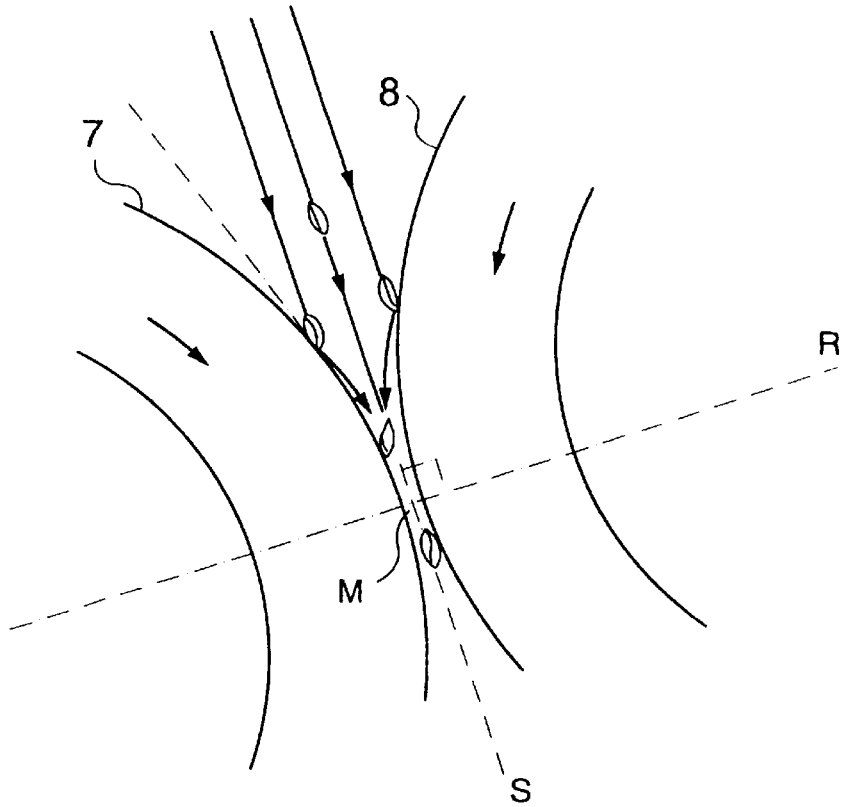
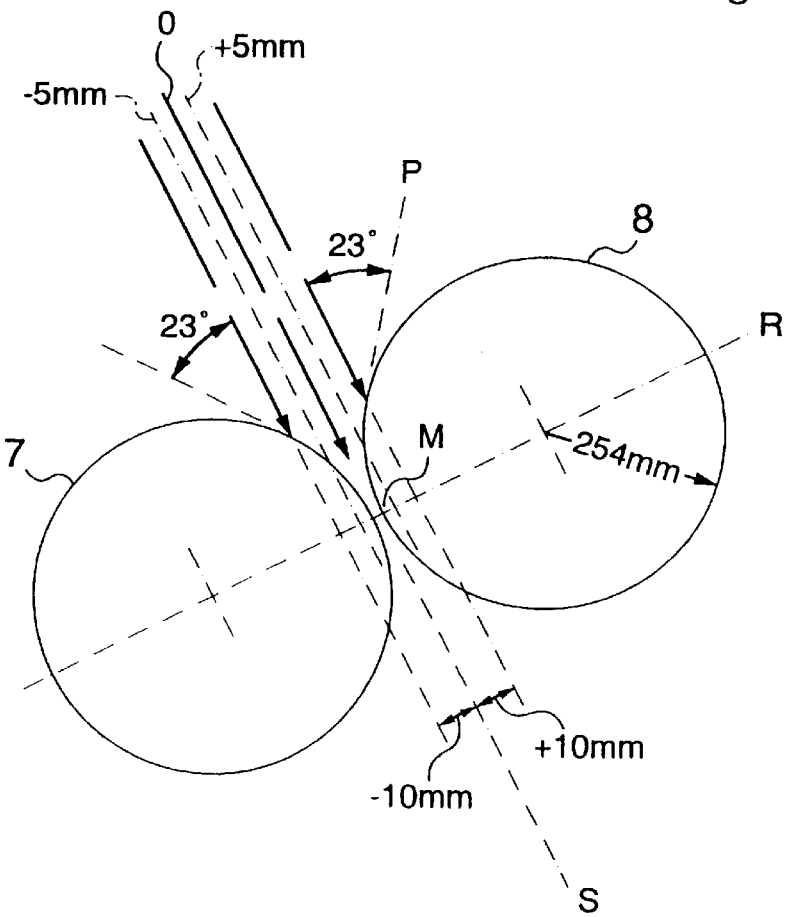
FIG. 5

FIG. 7

| No | THROWING POSITION | WHOLE HUSKED RICE(g) | BROKEN GRAIN(g) | WHOLE UNHUSKED RICE(g) | HUSKING RATE(%) | AVERAGE HUSKING RATE | BROKEN-GRAIN RATE(%) | AVERAGE BROKEN-GRAIN RATE |
|---|---|---|---|---|---|---|---|---|
| 1 | -15mm | 96.01 | 9.05 | 5.42 | 96.04 | (%) 96.3 | 8.61 | (%) 8.4 |
| 2 | -15mm | 101.32 | 8.93 | 4.89 | 96.57 | | 8.10 | |
| 3 | -10mm | 103.89 | 3.17 | 4.89 | 96.47 | 96.6 | 2.96 | 2.9 |
| 4 | -10mm | 103.41 | 3.04 | 4.57 | 96.68 | | 2.86 | |
| 5 | -5mm | 104.43 | 3.36 | 5.99 | 95.74 | 96.2 | 3.12 | 2.9 |
| 6 | -5mm | 104.2 | 2.96 | 4.73 | 96.59 | | 2.76 | |
| 7 | 0mm | 104.79 | 2.8 | 6.62 | 95.31 | 95.6 | 2.6 | 3 |
| 8 | 0mm | 101.94 | 3.47 | 5.67 | 95.87 | | 3.29 | |
| 9 | +5mm | 105.33 | 3.48 | 3.64 | 97.39 | 96.4 | 3.2 | 3.6 |
| 10 | +5mm | 98.27 | 3.96 | 6.2 | 95.37 | | 3.38 | |
| 11 | +10mm | 102.34 | 3.66 | 5.13 | 96.27 | 96.5 | 3.45 | 3.5 |
| 12 | +10mm | 104.02 | 3.9 | 4.52 | 96.76 | | 3.61 | |
| 13 | +15mm | 103.25 | 9.05 | 5.42 | 96.04 | 96.2 | 3.84 | 7.2 |
| 14 | +15mm | 100.92 | 8.93 | 4.89 | 96.57 | | 7.62 | |

FIG. 9
PRIOR ART

| No | THROWING POSITION | WHOLE HUSKED RICE(g) | BROKEN GRAIN(g) | WHOLE UNHUSKED RICE(g) | HUSKING RATE(%) | AVERAGE HUSKING RATE | BROKEN-GRAIN RATE(%) | AVERAGE BROKEN-GRAIN RATE |
|---|---|---|---|---|---|---|---|---|
| 1 | -15mm | 92.52 | 11.25 | 5.89 | 95.66 | (%) | 10.84 | (%) |
| 2 | -15mm | 93.63 | 13.12 | 5.57 | 95.99 | 95.9 | 12.29 | 11.8 |
| 3 | -15mm | 91.14 | 12.81 | 5.23 | 96.13 | | 12.32 | |
| 4 | -10mm | 89.87 | 7.35 | 6.03 | 95.27 | | 7.56 | |
| 5 | -10mm | 89.63 | 7.56 | 6.07 | 95.24 | 95.1 | 7.75 | 7.6 |
| 6 | -10mm | 89.18 | 7.22 | 6.31 | 95.02 | | 7.49 | |
| 7 | -5mm | 95 | 3.15 | 4.91 | 96.24 | | 3.21 | |
| 8 | -5mm | 98.52 | 3.03 | 5.71 | 95.8 | 95.8 | 2.98 | 3.2 |
| 9 | -5mm | 97.48 | 3.38 | 6.2 | 95.42 | | 3.35 | |
| 10 | +0mm | 102.64 | 4 | 5.31 | 96.35 | | 3.75 | |
| 11 | +0mm | 100.71 | 4.06 | 5.84 | 95.94 | 95.9 | 3.88 | 3.7 |
| 12 | +0mm | 101.47 | 3.52 | 6.45 | 95.54 | | 3.35 | |
| 13 | +5mm | 97.38 | 5.21 | 5.82 | 95.66 | | 5.08 | |
| 14 | +5mm | 99.13 | 5.75 | 6.15 | 95.52 | 95.5 | 5.48 | 5.5 |
| 15 | +5mm | 102.15 | 6.57 | 6.89 | 95.17 | | 6.04 | |
| 16 | +10mm | 93.99 | 8.95 | 6.73 | 95.03 | | 8.69 | |
| 17 | +10mm | 91.64 | 7.85 | 5.62 | 95.68 | 95.6 | 7.89 | 8.6 |
| 18 | +10mm | 101.49 | 10.47 | 5.78 | 96.03 | | 9.35 | |
| 19 | +15mm | 102.25 | 12.72 | 6.58 | 95.62 | | 11.06 | |
| 20 | +15mm | 98.76 | 12.15 | 6.92 | 95.90 | 95.7 | 10.95 | 11.6 |
| 21 | +15mm | 92.74 | 13.64 | 6.07 | 95.63 | | 12.82 | |

ROLL TYPE HUSKING APPARATUS WITH INCLINED GUIDE CHUTE

BACKGROUND OF THE INVENTION

The present invention relates to a roll type husking apparatus for cereal grains.

This type of husking apparatus includes a pair of rubber rolls having an adjustable spacing or clearance between them, and a cereal hopper or tank disposed above the rubber rolls. The apparatus is adapted to feed cereal grains from the tank, through a feeding adjustment device such as a transfer roll and a flow adjusting valve, between the rubber rolls. The rubber rolls rotate inward with a difference between their peripheral speeds, respectively, and the cereal grains, when passing between the rolls, are husked by the pressure and rotation of the rolls. In this case, when the cereal grains are directly provided between the rolls through the transfer roll and the flow adjusting valve, they reach the rolls in irregular postures and in a layer of non-uniform thickness.

The cereal grains, thus fed in irregular postures and with non-uniform thickness, overlap each other between the rubber rolls and are liable to become broken grains due to the pressure and velocity differential of the rubber rolls. Further, as the quantity of cereal grains being fed is irregular, the husking is not carried out uniformly. Moreover, a high pressure is required between the rolls, that is, the roll clearance has to be set narrow, and therefore, broken grains tend to be produced.

On the other hand, there is another roll type husking apparatus which uses an inclined chute in the feeding adjustment device to attempt providing cereal grains in a thin layer. Such an apparatus is illustrated, for instance, in FIGS. 9 and 10 of GB2054346A and described in the associated description.

SUMMARY OF THE INVENTION

It is an object of the present invention to provide a husking apparatus which can solve the above problems.

Another object of the invention is to provide a husking apparatus which causes less broken grains and achieves a high husking rate.

The invention has a further object of providing a husking apparatus which improves a broken-grain rate and a husking rate and can enjoy a desirable throughput.

To these ends, the invention is designed to use, for a feeding adjustment device, a construction of feeding cereal grains in regular postures at a uniform thickness and to arrange the adjustment device and rolls in the relation optimized for husking of the cereal grains thus fed.

The husking apparatus according to the invention employs an inclined guide chute for sliding down cereal grains to feed them between the first and second rolls. The guide chute and the first and second rolls are located so that a guide surface of the guide chute is substantially perpendicular to a line connecting the centers of rotational shafts of the first and second rolls, and that an extension line from the guide surface passes within a range of ±10 mm on both sides of the middle point of a clearance between the rolls. The guide surface of the guide chute has such an inclination that the cereal grains, while sliding down along the guide surface, may spread all over a width of the guide surface in the single layer of a band-like shape and be accelerated to a speed less than the peripheral speeds of the first and second rolls.

With this construction, the cereal grains slide down along the inclined guide chute and forms the uniformly spread layer of a thin band-like shape. At this time, most of the cereal grains are aligned in the posture of directing their lengths in the direction of sliding. Such cereal grains, as being thrown substantially vertically from the guide chute into the minimum clearance between the rolls, and as being slower than the peripheral speeds of the rolls, cause less irregular reflection due to collision with the rolls. The cereal grains are thus provided between the rolls in the thin band-like layer and in regular postures, and therefore, the rolls uniformly act on each of the cereal grains. As a result, it is possible to perform reliable husking which causes less broken grains.

The guide chute is preferably so located that the extension line from the guide surface passes through the middle point of the clearance between the first and second rolls. In this arrangement, the cereal grains, thrown from the guide chute and colliding with the rolls, hardly do irregular reflection.

The guide chute may be located so that the extension line from the guide surface passes through the middle point between the middle point of the roll clearance when the rolls are new and that when they are to be replaced. By this arrangement, even when the minimum clearance shifts due to wear of the rolls, the guide chute is always oriented to the area for restraining the irregular reflection of cereal grains. Accordingly, it is possible to simplify the construction of the husking apparatus by situating the guide chute in a fixed position.

Since the cereal is accelerated while slipping down along the guide chute, by properly setting the inclination of the guide chute, the cereal grains can be accelerated up to a supply speed for satisfying the throughput hoped for the husking apparatus.

The rolls may be provided in such a manner that one roll is movable relative to the other roll. In this case, considering the space for providing a roll moving mechanism and so forth, it becomes possible by disposing the fixed roll below the movable roll to construct the husking apparatus compactly and effectively. Furthermore, the lower roll is preferably at a higher speed. In such a roll arrangement, as far as at least the broken-grain rate is concerned, it is preferable for the guide chute to be directed within the range of 10 mm from the middle point of the roll clearance toward the fixed roll.

The guide chute may be constructed to be variable in its inclination. With this construction, depending on the degree of slidability of the guide surface, the moisture content of cereal grains and the like, the guide chute can be set to the optimum inclination, and the broken-grain rate and the husking rate are improved. In this case, the guide chute and the rolls are preferably mounted on a common base to be moved together, so that their relative position is not changed.

Furthermore, the guide chute, when provided for parallel movement, can be adjusted in such a way as to be directed to the optimum state or optimum area relative to the rolls, and it is possible to keep the broken-grain rate low and the husking rate high.

The rolls are worn away to decrease in diameter according as their use, and the position of the minimum clearance between them varies. In order to align the throwing position of cereal grains with the minimum clearance thus varying, a mechanism may be provided for moving the guide chute to change its inclination or position in accordance with the diameter of either roll. In this case, when the fixed roll is disposed below as described above, it is suited to detect the diameter of the fixed roll. The mechanism may be of the type mechanically operated by a lever, or may be what utilizing a photo-electric sensor for detecting the roll diameter and moving he guide chute by means of an electric motor. With such a construction, the guide chute can be automatically directed to the optimum position, making it possible to always keep the broken-grain rate low and the husking rate high.

It is preferable for the guide chute to be formed with grooves or channels in its guide surface, by which the cereal grains are more surely aligned with the respective lengths of them directed in the direction of sliding.

Preferably, the feeding adjustment device includes a feeder for conveying cereal grains from a hopper to the guide chute by means of vibration. With such a feeder, during the conveyance by vibration, the cereal grains uniformly spread and are fed in a thin, band-like layer, and the adjustment and alignment of the cereal grains by the guide chute can be performed more surely. The feeder may have an adjustable vibrating level so that the flow rate can be adjusted in accordance with the variety and size of cereal.

BRIEF DESCRIPTION OF THE DRAWINGS

The above and other features and advantages of the invention will be appreciated from the description which will be made below with reference to the accompanying drawings wherein:

FIG. 4 is a schematic illustration for explanation of the condition of introducing of cereal grains between the rolls in the apparatus according to the invention;

FIG. 5 is an explanatory illustration for the optimum range of condition of introducing of cereal grains in the apparatus according to the invention;

FIG. 7 is a table showing the result of an experiment for obtaining the husking rate and the broken-grain rate in the apparatus according to the invention;

FIG. 9 is a table showing the result of the experiment of FIG. 8;

DETAILED DESCRIPTION OF THE PREFERRED EMBODIMENTS

Figure 1:
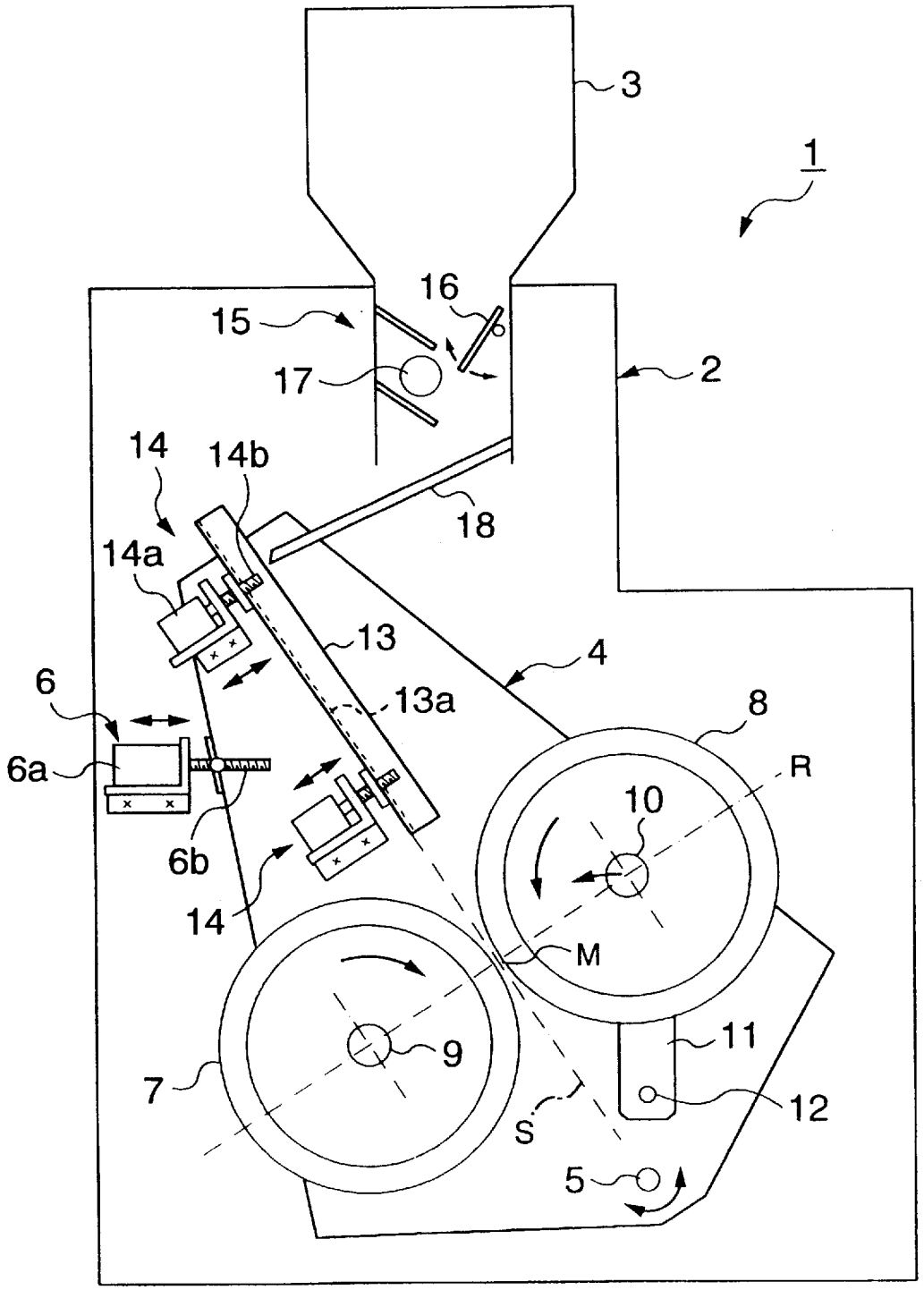
FIG. 1 is a schematic sectional view of the husking apparatus according to an embodiment of the invention.

Referring to FIG. 1, the husking apparatus according to an embodiment of the invention is generally denoted by numeral 1. The apparatus 1 has a framework 2, on an upper portion of which a cereal hopper 3 is mounted, and in the inside of which a base 4 is mounted. The base 4 is rotatable in a vertical surface around a lower fulcrum or support 5. Generally denoted by numeral 6 is a mechanism for tilting the base 4. The mechanism 6 rotates a screw shaft 6*b* by a motor 6*a* so as to tilt the base 4 rightward and leftward. The motor 6*a* can be rotated forward and reversely by a manual switch which is disposed outside the framework 2.

A pair of rubber rolls 7, 8 are rotatably provided on a lower portion of the framework 2. One of the rubber rolls is adjustably mounted so as to be movable close to and away from the other roll to change a spacing or clearance between them. The rubber rolls are driven in opposite directions to each other with a difference between their rotational speeds by a driving mechanism, not shown. The clearance between the rubber rolls 7, 8 is usually set to about 0.5 mm and is adjusted to retain this value.

The rubber rolls 7, 8 are mounted to the lower portion of the base 4 and rotated inward, respectively, in such a manner that the upper portion of each roll is on a biting side and the lower portion thereof is on a discharging side. In the embodiment, each roll has a diameter of 254 mm when it is new, which decreases to 231 mm when the roll is to be replaced, a rubber layer thickness of about 20 mm and a width of 254 mm. The rolls are made of an urethane rubber and rotated at about 800 rpm and about 1000 rpm, respectively. The rubber roll 7 has a rotary shaft 9 which is fixedly supported by the base 4 in such a manner that the position of the shaft is not moved. On the other hand, the rubber roll 8 has a rotary shaft 10 supported on the end of a rocking plate 11 for changing the shaft position. The rocking plate 11 is rotatable around a support 12 at its lower portion and can urge the movable rubber roll 8 toward the fixed rubber roll 7. Furthermore, the fixed rubber roll 7 is located below the movable rubber roll 8, and a roll axis R connecting the center of the rotary shaft 9 of the roll 7 to that of the rotary shaft 10 of the roll 8 is inclined.

Above the rubber rolls 7, 8 is provided a guide chute 13 which constitutes part of a cereal feeding adjustment device. The chute has a plain guide surface 13*a* of a constant width for guiding and feeding cereal grains between the rubber rolls. In this embodiment, the guide chute 13 is made of a stainless steel, and the guide surface is 248 mm in width and 740 mm in length. Alternatively, the guide chute may be made of a metal such as an aluminum alloy or a synthetic resin such as a polyethylene, which has slidablility. The guide chute 13 is inclined in such a manner that a throwing line S of cereal grains by the guide chute 13*a*, that is, an imaginary extension line from the guide surface, passes through the middle point M of the clearance between the rubber rolls 7, 8 and cross the roll axis R substantially perpendicularly thereto. The guide chute 13 is mounted to the base 4 via a plurality of shift devices 14, 14 each of which has a motor 14*a* and a screw shaft 14*b*. The motor 14*a* is rotated forward and reversely by a manual switch disposed outside the framework 2 to move the guide chute 13 by means of the screw shaft 14*b*. Accordingly, the shift devices 14, 14 can move the guide chute 13 parallel to the throwing line S. Furthermore, by tilting the base 4 through the tilting mechanism 6, an inclination angle of the guide chute 13 can be adjusted. In this case, the pair of rubber rolls 7, 8 are also moved together with the base 4 while keeping a relative position thereof to the guide chute 13 unchanged, and therefore, the throwing line S remains in the state of being substantially perpendicular to the roll axis R.

Meanwhile, the expression "substantially perpendicular" used herein means that the condition of "completely perpendicular" is ideal, but, practically, there may be a tolerance or error of few degrees from perpendicularity due to a manufacturing tolerance, wear of the rolls and so forth.

A cereal feeding mechanism 15 is provided between the cereal tank 3 and the guide chute 13. The mechanism comprises a flow adjusting valve 16, a transfer roll 17 and an inclined shelf plate 18, which are arranged subsequently from above. With this arrangement, the cereal grains in the tank 3, typically unhusked rice, are transferred continuously onto the shelf plate 18 while the flow rate is being adjusted, and are supplied from an end of the shelf plate 18 to the guide chute 13.

An operation of the apparatus is accomplished by opening the flow adjusting valve 16 and rotationally driving the rolls 7, 8 to start husking. As described above, the cereal grains in the tank 3 flow from the shelf plate 18 into the guide chute 13. The cereal grains are then fed from the end of the guide chute 13 along the throwing line S into the clearance between the fixed rubber roll 7 and the movable rubber roll 8 on their the biting sides. At this time, the cereal grains being fed are accelerated due to the inclination of the shelf plate 18 and the guide chute 13, and also by the action of the inclined guide surfaces of them, the cereal grains finally spread over all the width of the guide chute 13, and flow down in the form of a substantially one-layered band shape. The term "one or single layer" used herein means a layer which has the thickness of almost one cereal grain and in which a plurality of cereal grains do not overlap each other in the direction of the layer thickness. In addition, the respective cereal grains, while flowing along the guide chute 13, come to move with their longitudinal directions aligned with the throwing line of the guide chute.

The cereal grains nipped between the rolls are husked due to the velocity differential and pressure between the rolls 7, 8, and then are discharged downward. Herein, it is assumed that the cereal grains to be husked are Indica rice, and that the apparatus is provided with 10-inch rubber rolls and has the throughput of 5 ton/h. In this case, the peripheral speed of the rubber roll is set to 9.6 to 10.6 m/s for the low-speed movable rubber 8. Moreover, the flow speed of the cereal grains for satisfying the throughput of 5 ton/h is about 5.5 m/s with respect to the guide chute of the above-described size. The throughput is accomplished by operating the tilting mechanism 6 to adjust the inclination of the guide chute 13 in such a manner that the cereal grains to be fed between the rubber rolls 7, 8 are accelerated up to this speed. It should be noted that this speed of the cereal grains is sufficiently smaller than the peripheral speed of the low-speed roll.

For best understanding of the features of the invention, description will be now made on the analysis of the prior art which was made by the present inventors.

Figure 2:
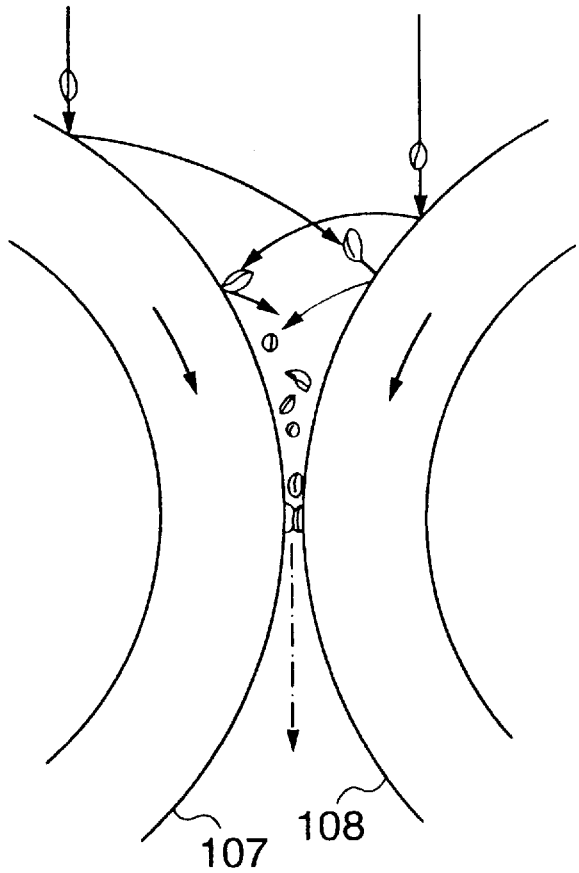
FIG. 2 PRIOR ART
FIG. 2 is a schematic illustration for explanation of the irregular reflection of cereal grains between rolls in a conventional apparatus.

In general, a conventional roll type husking apparatus has a pair of rubber rolls disposed with their shaft axes positioned at a substantially same height. Cereal grains are thrown toward the area where the clearance between the rubber rolls is minimum, through the transfer roll and the flow adjusting valve or the guide chute. At this time, with the transfer roll and the flow adjusting valve alone, as described above, the cereal grains are fed in irregular postures and in a layer of uneven thickness. As a result, as shown in FIG. 2, many cereal grains collide with the surfaces of rubber rolls 107, 108 and rebounded at large angles. This is repeated many times, that is, the cereal grains have irregular reflection, and they are not immediately bitten with the nip between the rubber rolls.

Figure 3:
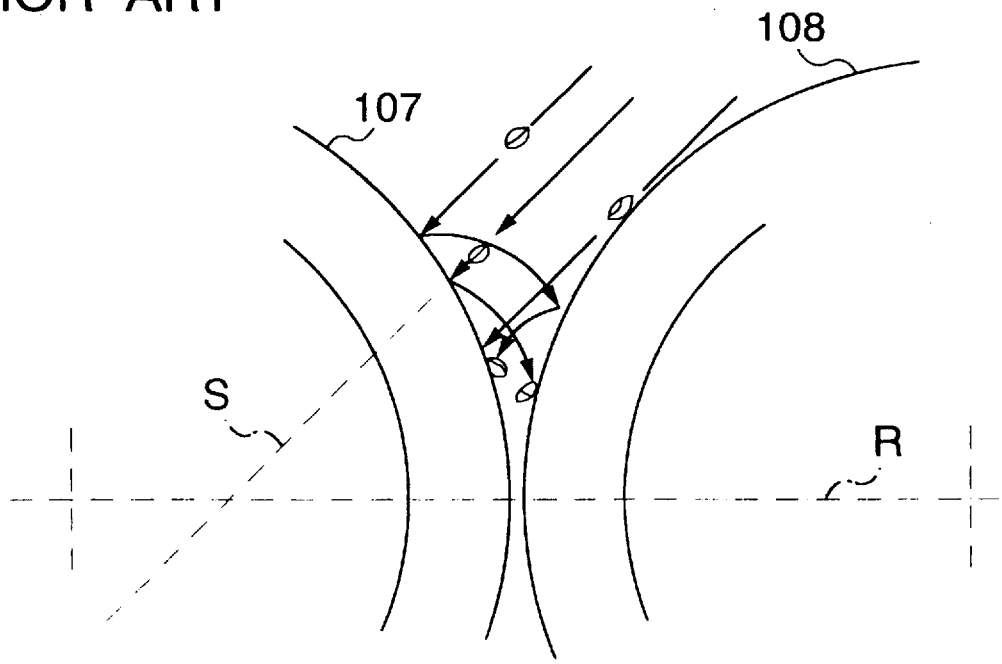
FIG. 3 PRIOR ART
FIG. 3 is an explanatory illustration for the irregular reflection of cereal grains between rolls in another conventional apparatus.

Furthermore, as shown in FIG. 3, when the introducing angle of cereal grains, that is, the angle of the throwing line S of cereal grains is inclined relative to the roll axis R of the rubber rolls, it is difficult to correctly supply cereal grains into the minimum clearance between the rubber rolls, the irregular reflection occurs in a similar way. This applies to the guide chute having a predetermined inclination. As for such cereal grains irregular in their postures, in particular long grain rice, there is much possibility that broken grains are generated between the rubber rolls 107 and 108. With the guide chute, as the cereal is accelerated to be fed, if the introduced cereal grains miss or come out of the minimum clearance between the rubber rolls, they are sprung out by the rubber rolls. In order to avoid this, it is necessary to introduce the cereal as correctly as possible, and it is difficult to set the inclination angle of the guide chute.

Moreover, the more rubber roll is used, the more it is worn. Accordingly, the point where the clearance between rolls is minimum is gradually varied. Thus, it is more difficult to introduce the cereal grains into the minimum point of the nip between the rubber rolls from the guide chute.

The present invention, to solve the above problems, in the first place, employs the guide chute 13 in the feeding adjustment device for cereal grains. The guide chute and the rolls 7, 8 are effectively located in such a manner that the cereal grains are thrown into the optimum range between the rolls. The guide chute 13 is so constructed as to have a function of forming cereal grains from the tank 3 in the layer of a uniform thickness and a constant width and feeding them between the rubber rolls 7, 8 at a predetermined speed. This function depends on the slidability of a material of the guide chute and the width, length and structure of the guide surface. However, when these are fixed, that is, the guide chute 13 to be used is determined, the function can be set mainly by adjusting the inclination angle of the guide chute 13.

More specifically, the rolls 7, 8 are disposed with their shaft axes positioned at a different height. On the other hand, as shown in FIG. 4, the guide chute 13 is located so that the direction of the cereal grains, which are guided by the chute to jump off, or the throwing line S, is substantially perpendicular to the roll axis R of the rubber rolls 7, 8 and directed to the optimum range between the rolls. Furthermore, the guide chute 13 is inclined at such an angle that the cereal grains to be fed to the rubber rolls 7, 8 are accelerated into a speed range which satisfies the throughput hoped for the husking apparatus and does not exceed the roll peripheral speed.

The throughput hoped for the husking apparatus means a quantity which is expected to be husking-processable within a predetermined time. This ability depends on the width of the guide chute 13 and the thickness of the layer of cereal grains being fed, as well as on the flow speed of cereal grains. Accordingly, when the width of the guide chute and the thickness of the layer of cereal grains to be fed are fixed, the necessary flow speed of cereal grains for satisfying the ability can be determined. The width of the rubber rolls 7, 8 is constant, 10 inch or about 254 mm in the embodiment described above, and the width of the guide chute is also constant. In this case, the thickness of the layer of cereal grains to be supplied is determined by the extent of opening of the flow adjusting valve.

Provided that the cereal grains are fed in the single layer of a band-like shape over the full width of the 10-inch rolls, the throughput of 5 ton/h needs the cereal grain speed of about 5.5 m/s, and the cereal grain speed of about 7.5 m/s is required when the throughput is 7 ton/h. On the other hand, usually, the rubber rolls are rotationally driven substantially constantly at a peripheral speed of 9 to 10 m/s. In the embodiment, a value within the range from 5.0 to 9.0 m/s is selected as the cereal grain speed.

With this construction, the cereal grains from the tank 3, while flowing along the guide chute 13, spread thinly and uniformly all over the guide surface 13*a* and have the respective lengths directed in the direction of movement. The cereal grains then collide, while being in this posture, with the peripheral surfaces of the rubber rolls 7, 8. At this time, as the direction of movement of cereal grains is substantially matched with direction of rotation of the rolls, and as the speed of cereal grains is a little slower than the peripheral speeds of the rolls, as shown in FIG. 4, the cereal grains have only a small reaction force and do not largely jump. Accordingly, the cereal grains being introduced between the rubber rolls 7, 8 are less irregular in posture.

Preferably, the throwing line S of cereal grains, that is, the inclination of the guide chute 13 is variable by a manual or power mechanism without altering a relative position thereof to the rubber rolls.

The guide chute, as shown in FIG. 5, is so located that the throwing line S is within the range of ±10 mm on both sides of the middle point M of the clearance between the rolls 7, 8. In this case, it is preferable for the guide chute to be disposed relative to the rolls in such a manner that the throwing line S passes through the middle point M of the clearance between the rolls 7, 8 as is in the embodiment of FIG. 1.

Within the above-described range, the angle, which is formed between a tangent line P of the roll peripheral surface at the point where a cereal grain collides, and the throwing line S, ranges from 0° at the middle point M of the clearance between the rolls 7, 8 to 23° at the point 10 mm apart from the middle point M. Within this angle range, the cereal grains colliding with the rubber rolls 7, 8 are reflected toward the nip between the rubber rolls 7, 8 in either case. Therefore, the cereal grains reflected due to the collision are also bitten in the husking area after only one reflection and are less irregular in their posture.

In some cases, such positioning of the guide chute may cause the throwing line S to come out of the middle point M of the clearance between the rolls or the range from +10 mm to −10 mm when the rubber rolls 7, 8 are worn. Accordingly, the guide chute is preferably formed to be movable in parallel by a manual operation or an automatic follow-up mechanism with a sensor for detecting the wear of the rubber roll, so as to correct its position.

Figure 6:
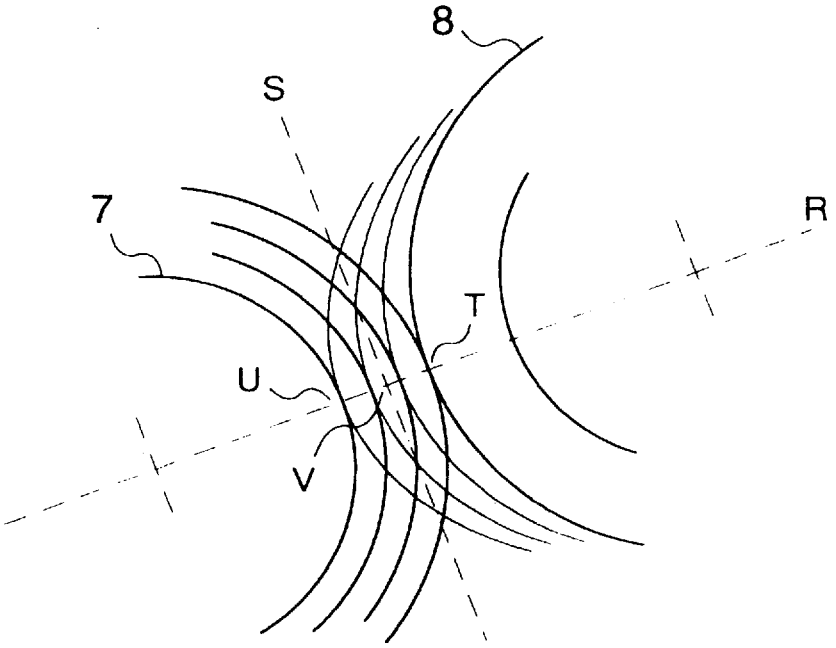
FIG. 6 is a schematic view showing a relationship between the shifting of a roll contact and throwing positions of cereal grains in the apparatus according to the invention.

Instead of the arrangement in the embodiment, as shown in FIG. 6, the guide chute may be arranged in such a manner that the throwing line S is substantially perpendicular to the roll axis R and it passes through a middle point V between a contact T of the new rolls 7, 8 when they are new and a contact U when they are to be replaced. Although the "contact" is referred to herein, as described above, actually, there is a clearance of about 0.5 mm between the rolls.

In this arrangement, even when the guide chute is held at a fixed position, despite of the wear of the rubber rolls 7, 8, the angle between the tangent line P, at the point where a cereal grain collides with the rubber roll peripheral surface, and the throwing line S is always within the range from 0° to 23°, and the irregular reflection of cereal grains can be restrained. More specifically, the 10-inch rubber roll usually used has a rubber layer of about 23 mm thickness when it is new, and the wear limit for use is about 20 mm, that is, a remaining rubber is about 3 mm in thickness. Accordingly, when the throwing line S of the guide chute is 10 mm offset from the contact T for new rolls toward the fixed side roll 7, the throwing line S is initially situated on the minus side by 10 mm from the contact of the rubber rolls 7, 8. The throwing line S passes through the middle point V when the rolls are in the midst of their wear range, and comes to be on the plus side by 10 mm from the contact U in the final stage of wear of the rolls. Thus, the throwing line S of the guide chute is within the above-described range of ±10 mm over the entire period of use of the rolls.

The guide chute may be formed in its guide surface with a plurality of channels or grooves parallel to the throwing line S so as to make the alignment of cereal grains sure. This will be described in detail later.

In view of a space for arranging a moving mechanism for the guide chute 13 and the movable rubber roll 8, it is better to dispose the fixed rubber roll 7 below the roll 8, so that the husking apparatus can be constructed more compactly and effectively.

Figure 10:
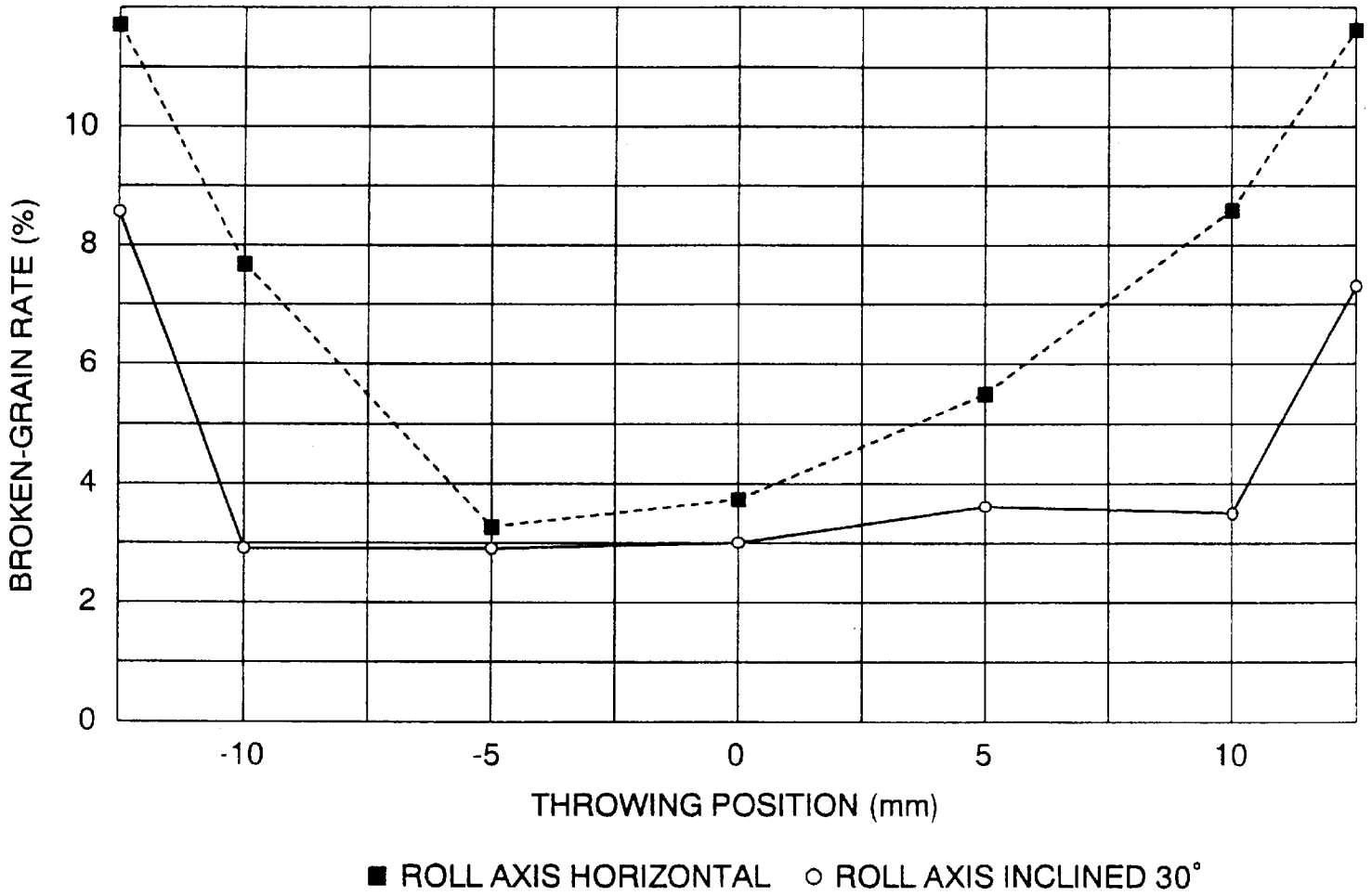
FIG. 10 is a graph showing the broken-grain rates of FIGS. 7 and 9 in comparison with each other.

FIG. 7 shows the result of an experiment in which husking rates and broken-grain rates are obtained in the husking apparatus wherein the throwing line S of the guide chute is substantially perpendicular to the roll axis R. FIG. 9 shows husking rates and broken-grain rates in a husking apparatus, in which the throwing line S of the guide chute is inclined relative to the roll axis, for comparison with the result of FIG. 7. Furthermore, FIG. 10 shows the broken-grain rates of FIGS. 7 and 9 in comparison with each other.

In the experiment of FIG. 7, the guide chute has an inclination of about 60° so that the speed of cereal grains when introduced between the pair of rolls is about 5 m/s. Furthermore, as for the rubber rolls, the fixed roll 7 is located lower than the movable roll 8 so that the throwing line of the guide chute is substantially perpendicular to the roll axis. See FIG. 5. Consequently, the roll axis is inclined at about 30° with respect to a horizontal line. A clearance of about 0.5 mm is set between the rolls 7, 8, and the fixed roll 7 is rotationally driven at a higher speed than the movable roll 8. The experiment was conducted to move the throwing line S from the middle point M toward the rolls 7, 8 by 5 mm, 10 mm and 15 mm, respectively, to obtain the husking rate and the broken-grain rate at each position. In FIG. 7, the throwing positions are represented in such a way that the middle point M is defined as zero, the side toward the lower roll 7 is defined as minus, and the side toward the upper roll 8 is defined as plus. In the experiment, Indica rice of long-grain variety is used and the rice is fed between the rolls at 5 ton/h.

Figure 8:
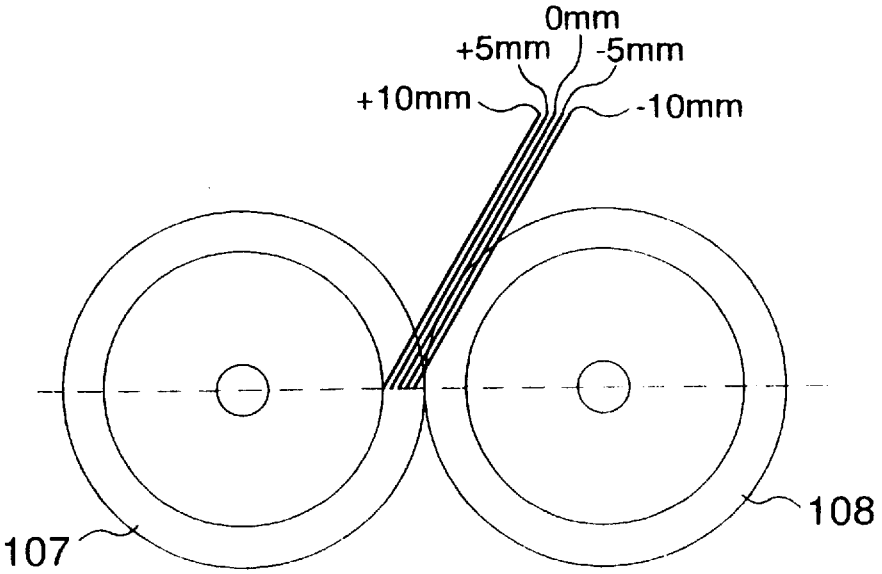
FIG. 8 PRIOR ART
FIG. 8 is a schematic illustration for explanation of the conditions of a similar experiment to that of FIG. 7, which was conducted in the conventional apparatus.

On the other hand, in the experiment of FIG. 9, as shown in FIG. 8, the rubber rolls 107, 108 are located with their rotary shafts being at the same height. The arrangement of other component elements and the operation condition are the same as the experiment shown in FIG. 7. Accordingly, differently from the experiment of FIG. 7, the guide chute is inclined at 60° relative to the roll axis of the rubber rolls 107, 108. The throwing positions in FIG. 9 are represented in such a manner that zero is defined as the position where the throwing line of the guide chute comes into contact with the peripheral surface of either roll on its biting side, the side toward the same roll is defined as minus, and the side toward the opposite roll is defined as plus.

In FIGS. 7 and 9, each husking rate is given, on the assumption that whole unhusked rice includes 20% of husk, by the following equation: [(whole husked rice weight+broken grain weight)/(whole husked rice weight+broken grain weight+whole unhusked rice weight×0.8)]×100(%). Furthermore, the broken-grain rate is expressed by the following equation: [broken grain weight/(broken grain weight+whole husked rice weight)]×100(%).

Comparing the data of FIG. 7 with that of FIG. 9, it is appreciated that the arrangement, in which the throwing line of the guide chute is substantially perpendicular to the roll axis, is better for both the husking rate and the broken-grain rate. Moreover, according to this arrangement, when the throwing line is located at any position within the range of ±10 mm, the husking rate is high and the broken-rice rate is low. In particular, as concerns the broken-grain rate, it will be appreciated that there is a large difference between the case where the throwing line is within the above range and the case where the throwing line is at −15 mm or +15 mm out of the above range. The reason for this is as follows. As described above, the guide chute throws cereal grains toward the minimum clearance between the rolls at a high speed with their lengths aligned in the direction of throwing and, therefore, the cereal grains are nipped between the rolls without disordering their postures. Accordingly, they are hardly broken by the rubber rolls, and the occurrence of broken grains are prevented.

Furthermore, from FIG. 10, it is appreciated that, when the throwing line is on the side of the high-speed rubber roll, that is, on the minus side, the broken-grain rate is lower. In particular, in the arrangement in which the pair of rolls are horizontal, the broken-grain rate is minimum in the neighborhood of −5 mm position. Also in the arrangement in which the guide chute is substantially perpendicular to the roll axis, the broken-grain rate becomes still smaller within the range between 0 to −10 mm. Accordingly, although it depends on a size of cereal grains, as far as at least the broken-grain rate is concerned, it is better to locate the throwing line on the minus side.

In the embodiment described above, the guide chute feeds cereal grains between the rolls while aligning the lengths of the cereal grains in the direction of the throwing line S. The speed of cereal grains at this time is less than the peripheral speeds of the rubber rolls. Furthermore, the guide chute is located in such a manner that the throwing line is substantially perpendicular to the roll axis of the rubber rolls 7, 8 and passes through the middle point M of the clearance between the rolls. As a result, the cereal grains are effectively nipped between the rubber rolls 7, 8 and have less irregular reflection upon collision with the rubber roll peripheral surface, and broken grains are reduced. Moreover, the cereal grains are fed between the rubber rolls 7, 8 in the substantially one-layered condition which is large in width. Accordingly, the generation of broken grains resulted from an excessive supply and the occurrence of incomplete husking are lessened, and the husking efficiency is improved.

Furthermore, as the guide chute 13 can be moved in parallel by the shift devices 14, 14, it is possible to always set the throwing line S through the middle point M of the roll clearance described above. Thus, effective husking, in which the irregular reflection of cereal grains and the generation of broken grains are reduced, can be carried out.

For always directing the throwing line S of the guide chute 13 to the middle point M of the roll clearance, the arrangement may be so constructed that the wear of either one of the rubber rolls 7, 8 is detected, and based on the detection, the shift devices 14, 14 are automatically driven. In this case, as a sensor for detecting the wear, a touch sensor mechanism is easy to employ, which has a roller mounted on one end of a lever and brings the roller into contact with the rubber roll surface so as to take a displacement of the roller at the other end of the lever. With this construction, the guide chute 13 is moved parallel in accordance with the wear of roll 7 or 8 so that the throwing line S may be always substantially perpendicular to the roll axis R and may pass through the middle point M of the roll clearance.

Figure 11:
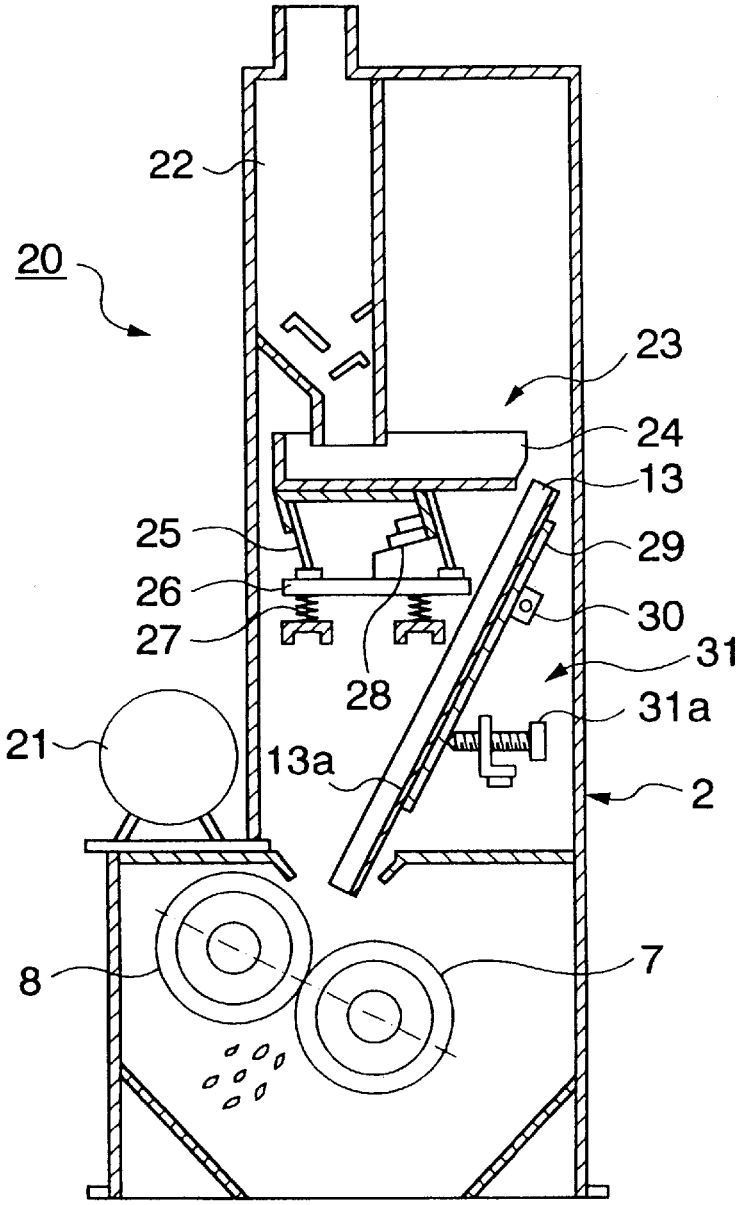
FIG. 11 is a schematic sectional view showing the husking apparatus according to another embodiment of the invention.

FIG. 11 shows the husking apparatus 20 according to another embodiment of the invention. Hereinafter, the same or similar elements to those of the first embodiment will have the same reference numbers, and the description will be omitted.

Also in this embodiment, the apparatus is so constructed that a straight line connecting the rotational axes of the pair of rubber rolls 7, 8 may be substantially perpendicular to a flying locus of cereal grains by the guide chute 13, and that the cereal grains may be introduced into the point where the clearance or spacing between the rubber rolls 7, 8 is minimum. The rubber rolls 7, 8 are rotationally driven by a motor 21 via a belt, not shown.

On the upper portion of the framework 2 is provided a tank 22 for storing cereal, and under the tank 22 is installed a vibration feeder 23 which receives the cereal from the tank and transfers the same. The feeder 23 includes a vibrating transfer frame 24 which is disposed substantially horizontally. The vibrating transfer frame 24 is mounted to a feeder base 26 via leaf springs 25, 25, and the feeder base 26 is mounted to the framework 2 via springs 27, 27. The feeder base 26 is also provided with a vibrating device 28 which can change a vibrating level.

The vibration feeder 23, by vibrating the transfer frame 24 through the vibrating device 28, conveys the cereal transferred from the tank 22 rightward in the drawing. The feeder may be one commercially available, and further description will be omitted.

Below the end of the feeder 23, the guide chute 13 is provided in the framework 2 at a predetermined angle of inclination so as to send the cereal grains transferred from the feeder between the rubber rolls 7, 8. The guide chute 13 is attached to a chute frame 29 which is in turn rotatably mounted around a support shaft 30. The guide chute 13 is provided with a tilting mechanism 31 for orienting the end of the chute to the minimum clearance between the rubber rolls 7, 8. The mechanism is adapted to adjust the inclination angle of the guide chute by a screw shaft 31*a* whose end is in contact with the chute frame 29. Similarly to the first embodiment described above, the width of the vibrating transfer frame 24 and the guide chute 13 of the feeder 23, that is, the length to a vertical direction in the drawing, is substantially equal to the width of the rubber rolls 7, 8.

In the operation of the apparatus, upon turning power supply on so as to actuate the motor 21, the rubber rolls 7, 8 are rotated in the opposite directions with a difference between their peripheral speeds. Subsequently, when the vibrating device 28 is actuated, the vibrating transfer frame 24 starts vibrating. The cereal grains transferred from the tank 22 spread in a band shape, and they drop down to the guide chute 13. The cereal grains dropped on the guide chute 13 slide down along the guide surface 13*a* and are fed between the rubber rolls 7, 8. The cereal is husked by the pressure and rotation of the rolls 7, 8 during they pass between the rolls.

According to this embodiment, a supply rate of cereal can be adjusted by changing the vibration level of the vibrating device 28, and such a flow adjusting valve as used in the first embodiment or a conventional husking apparatus is not required. Furthermore, since the feeder 23 carries the cereal grains by means of vibration, the cereal grains are distributed uniformly all over the width of the vibrating transfer frame 24 during the transfer, they are fed in a band-like shape to the guide chute.

The guide chute 13 is set to such length and inclination that cereal grains may be accelerated up to a speed more than 5 m/s during they slide down along the guide surface 13*a* and jump into the clearance between the rubber rolls 7, 8. The supply speed of cereal grains is adjusted to be about 5 m/s. The cereal grains supplied to the guide chute 13 slide down along the guide surface of the chute. During the sliding, they are forcibly arranged into the posture in which the lengths of most cereal grains are aligned in the direction of dropping. The cereal grains are accelerated and fed between the rubber rolls 7, 8 uniformly in the direction of their width while being in the state of a thin, band-like layer. As a result, the rubber rolls uniformly act on the respective cereal grains, husking is equalized, and in combination with the effect from the above-described arrangement of locating the throwing line substantially horizontally, the cereal can be efficiently husked.

According to this embodiment, as the layer of cereal grains is thinly equalized, the clearance between the rubber rolls 7, 8 may be set somewhat wider. Furthermore, the cereal grains are accelerated by the guide chute 13 to enter between the rubber rolls 7, 8. Accordingly, even if the layer of cereal grains is thinned, the flow rate of cereal grains to be passed between the rubber rolls can be increased, and the shelling efficiency can be improved. Furthermore, as the cereal grains are longitudinally aligned and supplied between the rubber rolls 7, 8, there are caused less broken grains.

Figure 12:
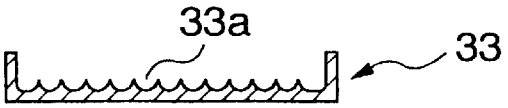
FIG. 12 is a sectional view showing a modification of the guide chute shown in FIG. 11.

FIG. 12 shows a modification of the guide chute. A guide chute 33 is formed in its guide surface with a plurality of channels or grooves 33*a* each of which extends in the longitudinal direction of the chute. The grooves serve to make the longitudinal alignment of cereal grains sure.

Figure 13:
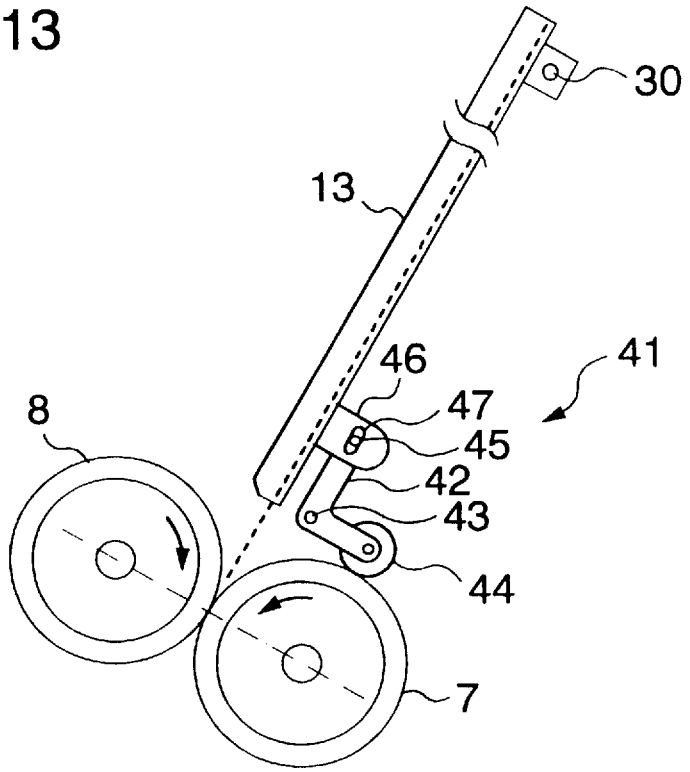
FIG. 13 is a schematic illustration showing a guide chute tilting mechanism which is applicable to the apparatus of FIG. 11.

FIG. 13 shows a tilting mechanism 41 for the guide chute, which is applicable to the embodiment of FIG. 11. According as the rubber rolls 7, 8 are used, they are worn, resulting in reduction of their diameters. In accordance with the reduction, the movable rubber roll 8 is moved by a similar mechanism, not shown, to the embodiment of FIG. 1, so as to maintain the predetermined clearance. Accordingly, the position where the clearance between the rubber rolls 7, 8 is minimum, shifts in accordance with the reduction of the diameter of the fixed rubber roll 7 due to the wear. The tilting mechanism 41 includes an L-shaped lever 42 which is rotatably supported by a shaft 43 provided in the framework 2. The lever 42 has a roller 44 rotatably provided on one end thereof, and brings the roller into contact with the fixed rubber roll 7. The lever 42 has a pin 45 provided on the other end thereof, which pin is engaged with an elongated hole 47 in an extending member 46 that is formed on the chute frame of the guide chute 13. When the diameter of the fixed roll 7 decreases, the contact roller 44 rotates the lever 42 clockwise in the drawing in accordance with the change in the diameter. At the same time, the other end of the lever 42 rotates the guide chute 13 around the shaft 30 to change the inclination of the guide chute 13. Thus, the guide chute 13 is automatically adjusted so that the cereal grains sliding along the chute may be thrown into the minimum clearance between the rubber rolls 7, 8.

Figure 14:
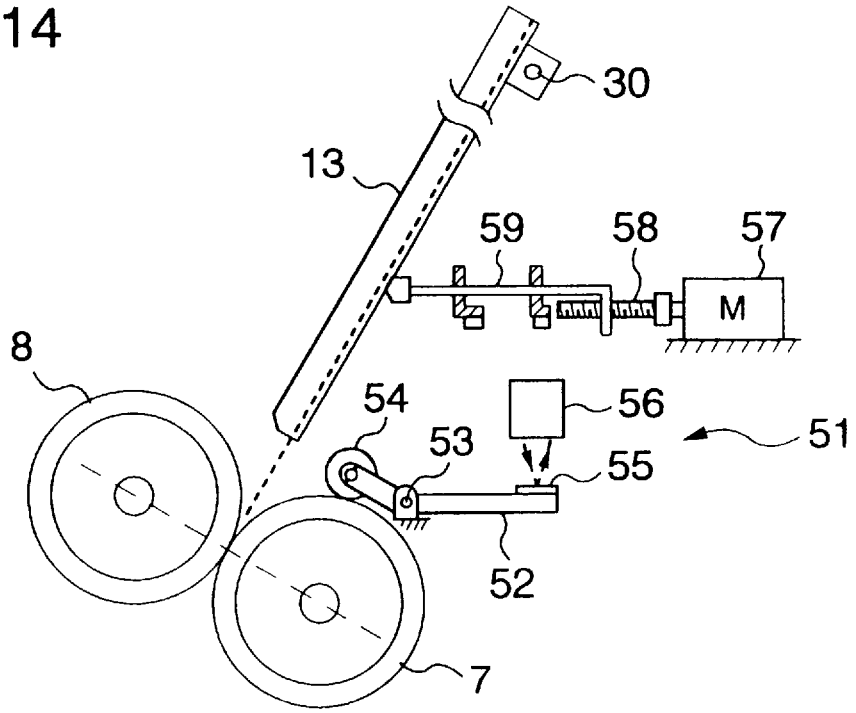
FIG. 14 is a schematic illustration showing another guide chute tilting mechanism which is applicable to the apparatus of FIG. 11.

FIG. 14 shows another example of the tilting mechanism. This tilting mechanism is designed to electrically perform the detection of the roll diameter and automatic adjustment of the inclination of the guide chute. This mechanism comprises a section for detecting the roll diameter and another section for moving the guide chute 13.

The detecting section includes a lever 52 which is rotatably supported by a shaft 53 provided in the framework 2. The lever 52 has a roller 54 rotatably mounted on one end thereof, which is in contact with an outer periphery of the fixed rubber roll 7. A reflection plate 55 is attached to the other end of the lever 52. A photoelectric sensor 56 is provided to face the reflection plate 55. The sensor 56 irradiates light, the light is directed onto the reflection plate 55, and the reflected light is received by receptor elements which are linearly arranged in the photoelectric sensor 56. The photoelectric sensor 56 judges the rotation position of the lever 52, that is, the diameter of the fixed rubber roll 7, from the position receiving the reflected light.

On the other hand, the moving section includes an electric motor 57 which is actuated in response to a measurement result by the photoelectric sensor 56. The rotational shaft of the motor 57 is provided with a screw 58. The moving section further includes an adjusting rod 59 which slidably but unrotatably mounted on the framework 2. The adjusting rod 59, at one end thereof, is in contact with the chute frame of the guide chute 13. At the other end of the adjusting rod 59 is formed a nut which is engaged with the screw 58 of the motor 57. Accordingly, when the motor 57 is actuated in accordance with the measurement by the photoelectric sensor 56, the adjusting rod 59 is moved rightward in the drawing according as the nut is moved along the screw 58, to change the inclination angle of the guide chute. Thus, even when the diameter of the rubber roll is reduced due to the wear to shift the minimum clearance between the rolls, the guide chute 13 is automatically adjusted so that the cereal grains may always slide down toward the minimum clearance.

Figure 15A:
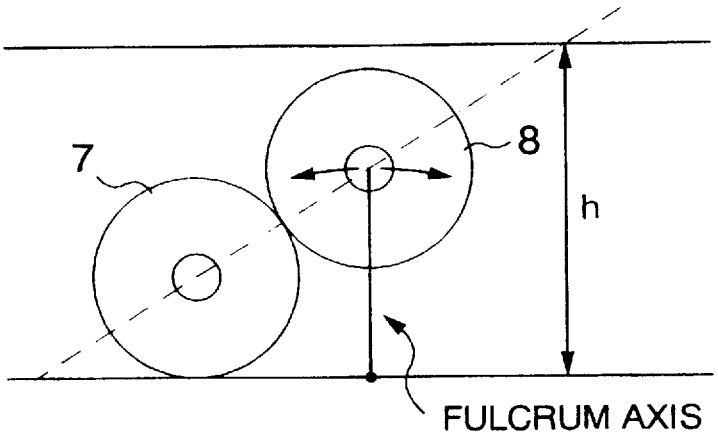
FIGS. 15A and 15B are schematic illustrations for explanation of the relationship in arrangement between a fixed rubber roll and a movable rubber roll.
Figure 15B:
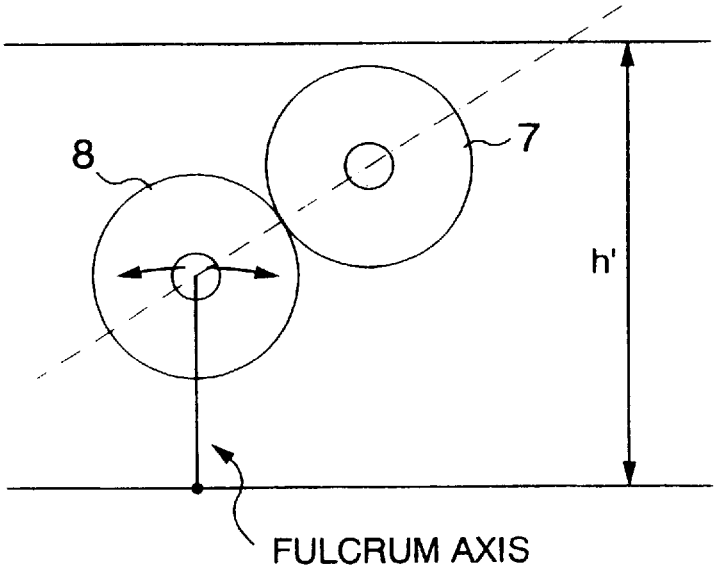

The relationship in arrangement of the rubber rolls 7, 8 will be now described with reference to FIGS. 15A and 15B. As is in the embodiments described above, when the fixed rubber roll 7 is located lower than the movable rubber roll 8, the husking apparatus can be made in a simple and compact construction. The reason is as follows. As shown in FIG. 15A, a space for disposing the mechanism for moving the movable rubber roll 8 can be ensured at both the upper side and the lower sides of the rubber roll, and in either case, the rubber rolls 7, 8 and the moving mechanism occupy a relatively small height h.

On the contrary, when the movable rubber roll 8 is located below, as the guide chute 13 exists above the roll 8, the mechanism for moving the rubber roll 8 must be located under the roll 8. Then, as shown in FIG. 15B, another space for disposing the roll moving mechanism has to be secured under the rubber rolls 7, 8. Accordingly, the rolls 7, 8 and the moving mechanism occupy a large height h', and it is difficult to construct a simple, compact husking apparatus.

In case where the inclination of the guide chute 13 is adjusted by such a link type tilting mechanism as shown in FIG. 13, the roller 44 of the link mechanism can be pressed onto the fixed rubber roll 7 by means of the load of the guide chute 13. On the other hand, if the movable rubber roll 8 is located below, because the movable rubber roll 8 is moved, the arrangement can not be so constructed as to press the roller 44 onto the roll 8. In this case, it can be thought that the roller 44 pushes onto the upper fixed rubber roll 7.

However, a force for pressing the roller 44 onto the rubber roll 7 cannot be obtained from the load of the guide chute 13. For these reasons, when the fixed rubber roll 7 is located upper, it becomes impossible to adjust the inclination angle of the guide chute 13 by such a link type tilting mechanism as shown in FIG. 13.

Accordingly, it is preferable to dispose the fixed rubber roll 7 lower than the movable rubber roll 8. However, the improvement of the husking rate and the broken-grains rate can be achieved, only by locating the throwing line of the guide chute substantially perpendicular to the roll axis and in the position described above according to the basic concept of the invention. In this sense, therefore, the fixed rubber roll may be located upper than the movable rubber roll.

The present invention has been described above on the basis of the embodiments. It should be noted that the invention is not limited solely to such specific forms, and that various changes are possible or the invention can take other forms within the scope of the appended claims.

What is claimed is:

1. A husking apparatus for cereals comprising:

a hopper storing cereal grains;

a first roll disposed below the hopper;

a second roll provided substantially parallel to said first roll with a clearance left from said first roll, said first and second rolls rotating in opposite directions with a difference between speeds thereof, respectively, to nip and shell the cereal grains between said rolls;

a feeding adjustment device including a guide chute disposed between said hopper and said first and second rolls, said guide chute having an inclined guide surface along which the cereal grains slide down between said first and second rolls;

said guide chute and said first and second rolls being located so that said guide surface of said guide chute is substantially perpendicular to a line connecting centers of rotational shafts of said first and second rolls and an extension line from said guide surface passes within a range of ±10 mm on both sides of a middle point of said clearance between said first and second rolls; and said guide surface of said guide chute having such an inclination that the cereal grains, while sliding down along said guide surface, spread all over a width of said guide surface in a substantially single layer of a band-like shape and are accelerated up to a speed less than peripheral speeds of said first and second rolls.

2. The apparatus according to claim 1, wherein said guide chute is located in a manner that said extension line from said guide surface passes through said middle point of said clearance between said first and second rolls.

3. The apparatus according to claim 1, wherein said guide chute is located so that said extension line from said guide surface passes through a middle point between a middle point of the clearance between said first and second rolls when said rolls are new and a middle point of the clearance between said first and second rolls when said rolls are to be replaced.

4. The apparatus according to claim 1, wherein said guide surface of said guide chute has such an inclination that the cereal grains are accelerated up to a supply speed which satisfies a throughput hoped for the husking apparatus.

5. The apparatus according to claim 1, wherein said first roll is provided with a position of the shaft thereof fixed, said second roll is provided with a position of the shaft thereof movable close to and away from said first roll, and said fixed first roll is disposed below said movable second roll and rotated at a higher speed than said second roll.

6. The apparatus according to claim 5, wherein said guide chute is located so that said extension line from said guide surface passes within a range of 10 mm from said middle point of said clearance between said first and second rolls toward said fixed first roll.

7. The apparatus according to claim 1, wherein said guide chute is pivotally provided so that the inclination of said guide surface can be changed.

8. The apparatus according to claim 7, wherein said guide chute is mounted on a common base together with said first and second rolls so that the inclination of said guide surface can be changed while retaining a relative position thereof to said first and second rolls unchanged.

9. The apparatus according to claim 1, wherein said guide chute is provided to be movable in parallel while retaining the inclination of said guide surface.

10. The apparatus according to claim 9, further comprising a mechanism for moving said guide chute in accordance with a diameter of one of said first roll and said second roll to change the inclination of said guide surface or a position thereof relative to said first and second rolls.

11. The apparatus according to claim 5, further comprising a mechanism for moving said guide chute in accordance with a diameter of said first roll to change the inclination of said guide surface or a position thereof relative to said first and second rolls.

12. The apparatus according to claim 11, wherein said mechanism comprises a pivotable lever, said lever supports at one end thereof a roller which is in contact with said first roll, and is connected at another end thereof to said guide chute.

13. The apparatus according to claim 11, wherein said mechanism comprises a photoelectric sensor detecting the diameter of said first roll, and an electric motor connected to said guide chute to move said guide chute in accordance with detection by said photoelectric sensor.

14. The apparatus according to claim 1, wherein said guide chute is formed in said guide surface with a plurality of grooves for aligning lengths of the sliding cereal grains in a direction of sliding.

15. The apparatus according to claim 1, wherein said feeding adjustment device includes a vibrating feeder, said vibrating feeder has a vibrating transfer frame which substantially horizontally extends between said hopper and said guide chute, and said transfer frame carries the cereal grains dropped from said hopper to said guide chute by means of vibration while spreading the cereal grains uniformly.

16. The apparatus according to claim 7, wherein said guide chute is provided to be movable in parallel while retaining the inclination of said guide surface.

* * * * *